US005973644A

United States Patent [19]

Haneishi et al.

[11] Patent Number: 5,973,644

[45] Date of Patent: Oct. 26, 1999

[54] PLANAR ANTENNA

[75] Inventors: Misao Haneishi, Urawa; Yutaka Imamura, Yokohama, both of Japan

[73] Assignee: Harada Industry Co., Ltd., Tokyo, Japan

[21] Appl. No.: 08/890,745

[22] Filed: Jul. 11, 1997

[30] Foreign Application Priority Data

Jul. 12, 1996 [JP] Japan ..... 8-183600

[51] Int. Cl.[6] ..... H01Q 1/38

[52] U.S. Cl. ..... 343/700 MS; 343/893; 343/915; 343/844

[58] Field of Search ..... 343/700 MS, 844, 343/893, 880, 757, 915, 908

[56] References Cited

U.S. PATENT DOCUMENTS 4,343,976 8/1982 Nasretdin et al. ..... 343/700 MS
4,792,810 12/1988 Fukuzawa et al. ..... 343/700 MS
5,063,389 11/1991 Reits ..... 343/359
5,121,127 6/1992 Toriyama ..... 343/700 MS
5,181,042 1/1993 Kaise et al. ..... 343/700 MS
5,351,062 9/1994 Knapp et al. ..... 343/880

*Primary Examiner*—Don Wong
*Assistant Examiner*—James Clinger
*Attorney, Agent, or Firm*—John P. White; Cooper & Dunham LLP

[57] ABSTRACT

A planar antenna comprises an emitting circuit plate having an emitting element made of a micro-strip antenna element, a first dielectric plate, and a feeder circuit plate having a feeder line, in which said feeder line are electromagnetically connected to said emitting element in said emitting circuit plate, and said emitting element is a ring circular emitting element containing a cross bridge conductor in the center thereof.

7 Claims, 4 Drawing Sheets

PLANAR ANTENNA

BACKGROUND OF THE INVENTION

This invention relates to an antenna having a tri-plate structure which utilizes a micro-strip antenna (MSA) as its emitting element.

FIG. 1A is a perspective view showing an example of a conventional planar antenna called ring micro-strip antenna of coaxial feeder type and FIG. 1B is a sectional view taken along the lines 1B—1B.

As shown in FIGS. 1A, 1B, in this planar antenna 100, a ring circular emitting element 101 made of micro-strip antenna element is formed on a side of a dielectric plate 102, a ground plate 103 made of metallic foil is formed on the other side of this dielectric plate 102 and then a core conductor 105 of a coaxial connector 104 is connected to a feeding point provided on part of the ring circular emitting element 101 such that an external conductor 106 of the coaxial connector 104 is connected to the ground plate 103. In the planar antenna 100 having the above structure, generally impedance matching between the ring circular emitting element 101 and the feeder line (core conductor 105 in the coaxial connector 104) is carried out by changing a ring ratio (b/a) between an outer diameter a and an internal diameter b of the ring circular emitting element 101.

However, if the ring ratio (b/a) is increased to ensure impedance matching between the ring circular emitting element 101 and the feeder line (core conductor 105 in the coaxial connector 104), a high impedance characteristic of more than several thousands is indicated, thus it is impossible to perform impedance matching by changing the ring ratio (b/a) widely. Although a variety of substitutive proposals have been presented, existing proposals contain such problems as a number of laminated layers is increased too much, a special matching circuit is required or the like. Additionally, it has not been easy to restrict cross-polarization component by ensuring symmetrical pattern by securing a symmetry in main mode.

BRIEF SUMMARY OF THE INVENTION

Accordingly, an object of the present invention is to provide a planar antenna mentioned below.

(a) Planar antenna in which impedance matching between emitting element and feeder system is facilitated.

(b) Planar antenna in which antenna gain is high and efficiency is excellent.

(c) Planar antenna in which pattern symmetry is excellent, thereby restricting cross polarization component.

To achieve the above object, the present invention provides a planar antenna comprising: an emitting circuit plate having an emitting element made of a micro-strip antenna element; a first dielectric plate; and a feeder circuit plate having a feeder line, in which said feeder line are electromagnetically connected to said emitting element in said emitting circuit plate, and said emitting element is a ring circular emitting element containing a cross bridge conductor in the center thereof.

Preferable manners are as follows.

(1) A first ground plate formed to surround said emitting element and therearound is further provided.

(2) An impedance matching between said emitting element and said feeder line is performed by adjusting a slot width of a ring slot between said emitting element and said first ground plate and further adjusting a shape of a path of said feeder line and a length of overlap area between said feeder line and said emitting element.

(3) A second dielectric plate and a second ground plate are further provided.

(4) An array antenna in which a plurality of said emitting element are two-dimensionally arranged is contained and an interval between said emitting element in said plurality thereof is adjustable.

(5) Said emitting element contains perturbation elements.

According to the present invention, the following planar antenna can be provided.

(a) Planar antenna in which impedance matching between emitting element and feeder system is facilitated.

(b) Planar antenna in which antenna gain is high and efficiency is excellent.

(c) Planar antenna in which pattern symmetry is excellent, thereby restricting cross polarization component.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1A, 1B show an example of a conventional planar antenna while FIG. 1A is a perspective view thereof and FIG. 1B is a sectional view taken along the lines 1B—1B in FIG. 1A;

FIGS. 4A, 4B show a result of actual measurement of the characteristic of a circularly polarization element having a pattern of the planar antenna shown in FIG. 3A according to an embodiment of the present invention, in which FIG. 4A shows a result of actual measurement of frequency characteristic about axial ratio and gain and FIG. 4B shows an example of emission pattern;

DETAILED DESCRIPTION OF THE INVENTION

Figure 1A:
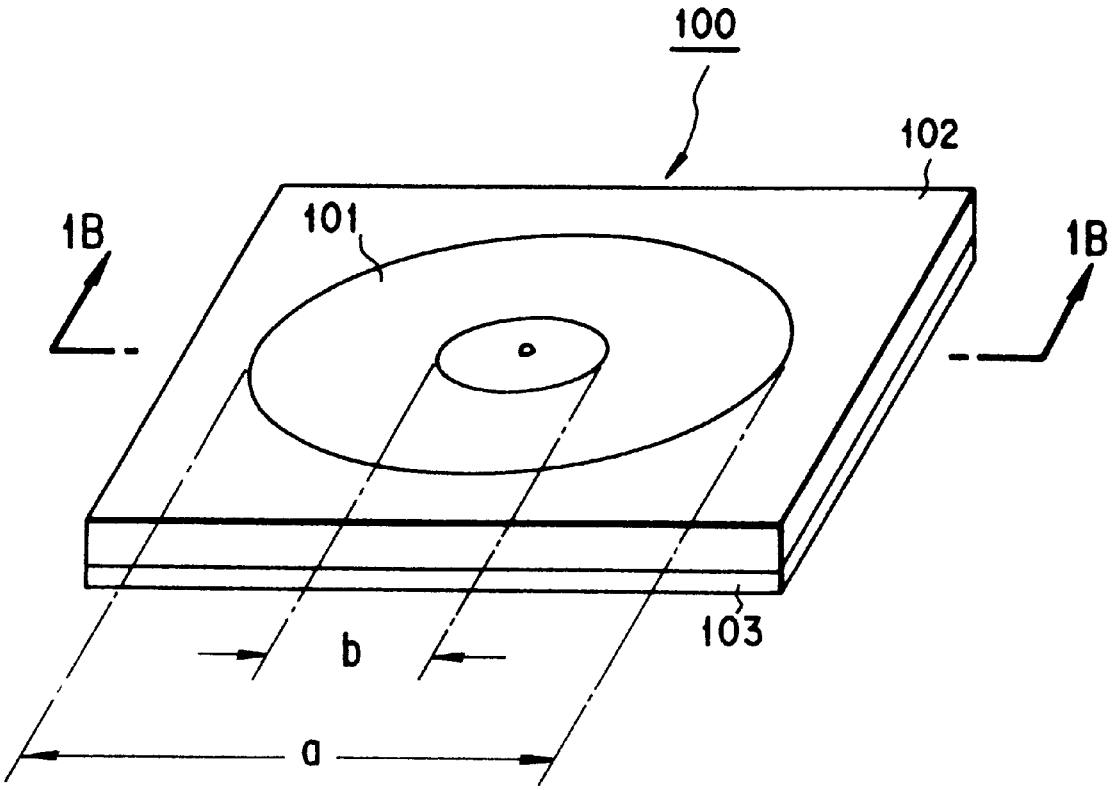
Figure 1B:
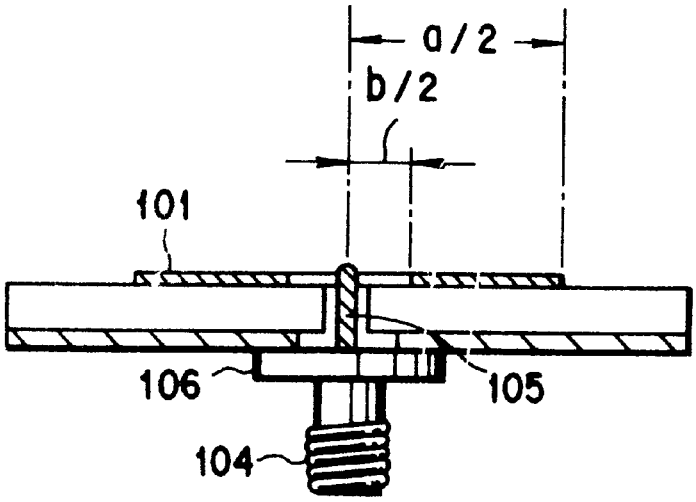
Figure 2:
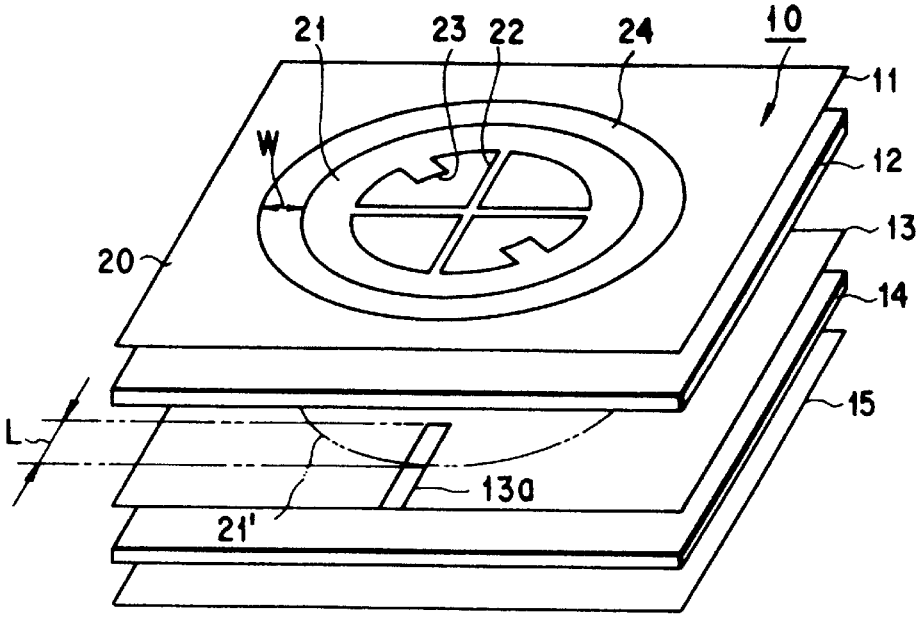
FIG. 2 is a disassembly perspective view showing an entire structure of a planar antenna according to an embodiment of the present invention.

FIG. 2 is a perspective view of an entire planar antenna, showing a structure thereof according to an embodiment of the present invention and FIGS. 3A–3H show pattern examples of an emitting element.

As shown in FIG. 2, a planar antenna 10 of the present invention comprises an emitting circuit plate 11 in which a ring circular emitting element is formed on an insulating film substrate, a first dielectric plate 12 made of a low dielectric constant such as a foamed material, a feeder circuit plate 13 having a feeder line 13*a*, a second dielectric plate 14 made of a low dielectric constant such as a foamed material, and a ground plate 15, which are laminated so as to provide a tri-plate structure.

On the emitting circuit plate 11, a ring circular emitting element 21 made of micro-strip antenna element is formed in the center thereof by etching such a conductor 20 as aluminum foil, copper foil and the like preliminarily formed on a square shaped insulating film substrate (not shown) made of polyester, polyimide, teflon or the like.

The ring circular emitting element 21 has a cross bridge in the center thereof. At two positions on an internal circumference of the ring circular emitting element 21 are formed protrusion shaped perturbation elements 23 which serve as circularly polarization elements. A ring slot 24 having a predetermined width is provided between the ring circular emitting element 21 and a conductor 20 (functions as a ground plate) surrounding an peripheral thereof.

Impedance matching between the ring circular emitting element 21 having the cross bridge 22 in the center thereof and the feeder line 13*a* provided so as to electromagnetically connect to this element 21 is carried out by not only adjusting and setting a slot width W of the ring slot 24 existing between the emitting element 21 and the conductor 20 surrounding this emitting element 21, but also adjusting and setting a shape of the path of the feeder line 13*a* and a length L (a fictitious line indicated by a numeral 21' indicates a position of an outer diameter of the emitting element 21) of overlap area between this feeder line 13*a* and ring circular emitting element 21.

Figure 3A:
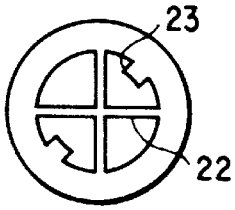
FIGS. 3A–3H show various pattern examples of the emitting element.
Figure 3B:
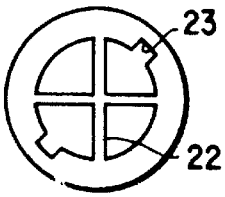
Figure 3C:
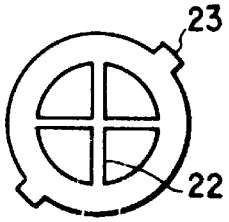
Figure 3D:
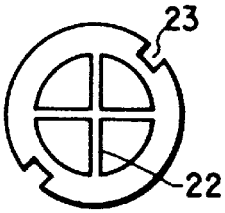
Figure 3E:
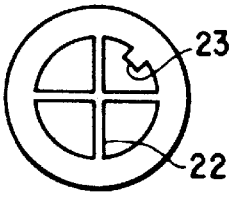
Figure 3F:
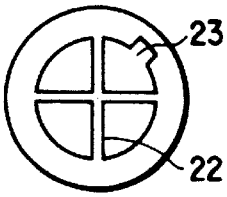
Figure 3G:
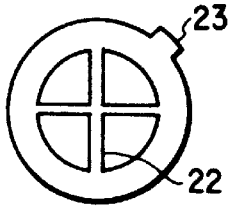
Figure 3H:
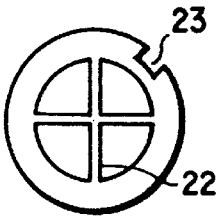

FIGS. 3A–3H shows pattern examples of the ring circular emitting element 21 having the cross bridge 22 and the perturbation element 23 in the center thereof. Although FIG. 3A is a pattern shown in FIG. 2, any patterns shown in FIGS. 3A–3H function as the circularly polarization element.

Figure 4A:
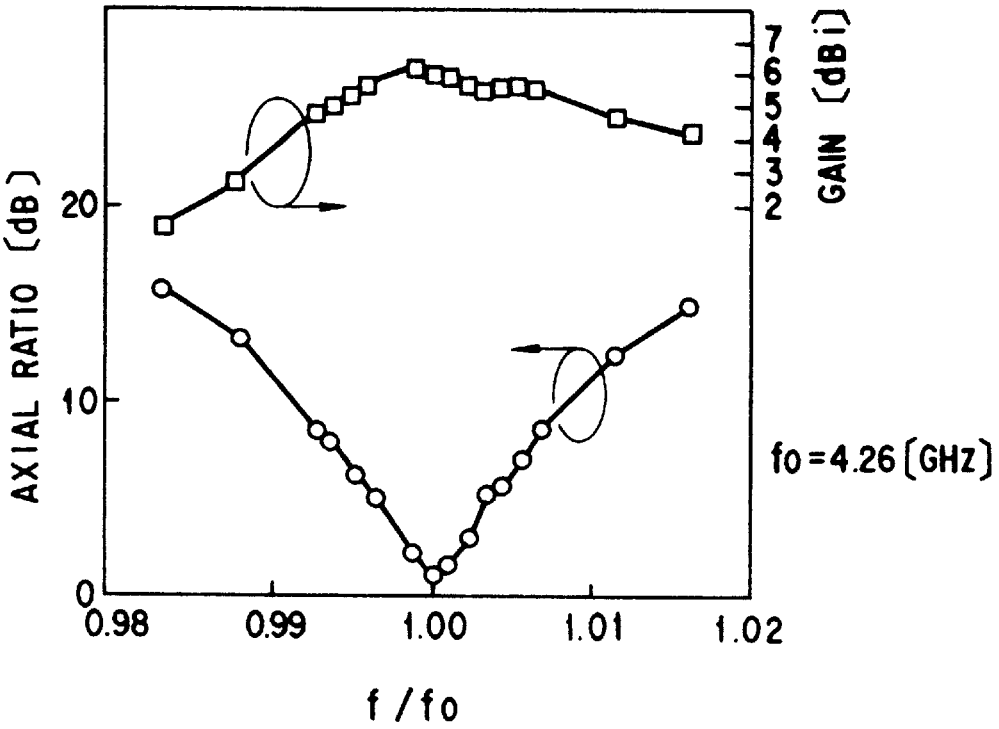
Figure 4B:
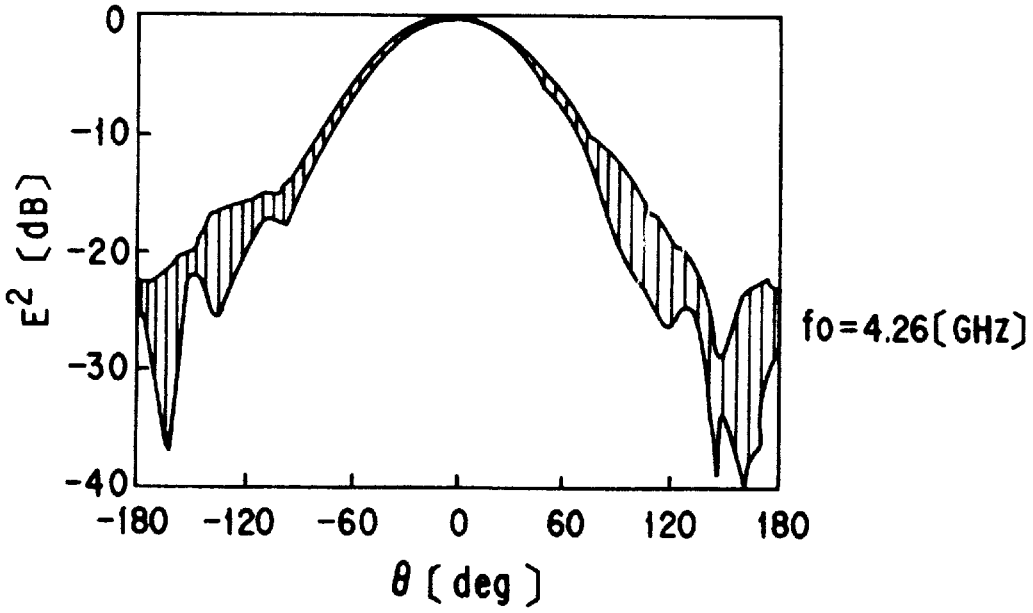

FIGS. 4A, 4B are diagrams showing a result of actual measurement of the characteristic of the circularly polarization element having a pattern shown in FIG. 3A according to the present invention. FIG. 4A shows a result of actual measurement of the frequency characteristic about axial ratio and gain, and FIG. 4B shows an example of emission pattern.

As shown in FIGS. 4A, 4B, an excellent characteristic as a circularly polarization antenna in which the gain is about 7 dB and the axial ratio of circularly polarization is about 0.5 dB has been gained.

Figure 5:
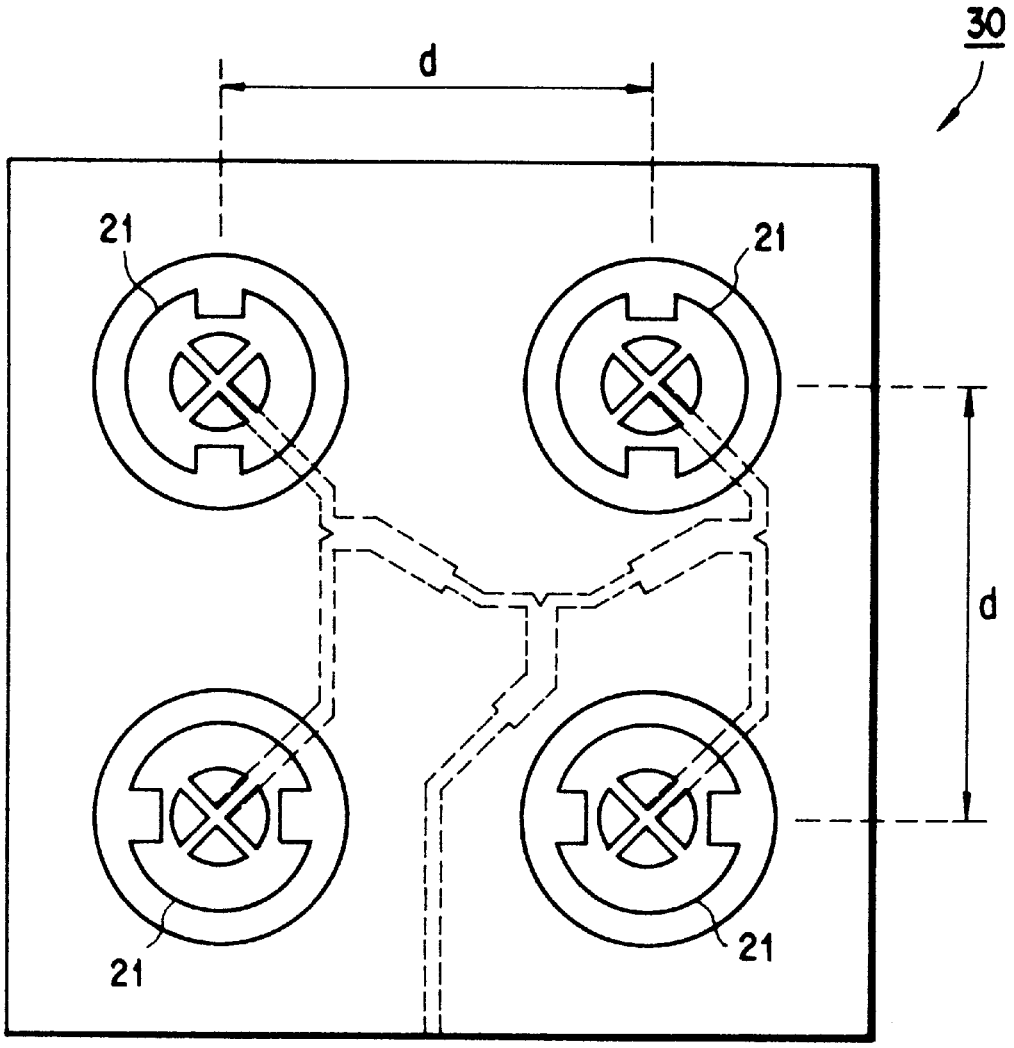
FIG. 5 shows a modification of an embodiment of the present invention and is a plan view of a case in which four pieces of ring circular emitting elements are combined so as to form a planar array antenna.

FIG. 5 is a plan view showing a modification in which four pieces of the ring circular emitting elements 21 are combined so as to form a planar array antenna 30. The respective ring circular emitting elements 21 are arranged in square shape such that each of them is apart by a predetermined width d from the other ones. In this planar array antenna 30, two pairs of the emitting elements 21, each pair being synthesized in terms of phase and rotated by 90° from the other pair, are arranged so as to ensure circularly polarization axial ratio and gain in broadband.

Figure 6:
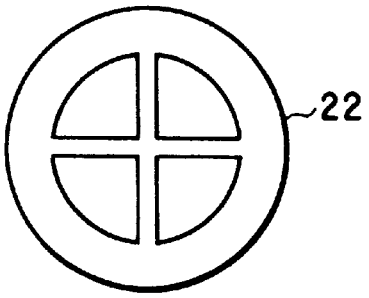
FIG. 6 shows a pattern example of a linearly polarization element formed by removing perturbation elements from a pattern shown in FIG. 3A.

FIG. 6 shows an example of a pattern in which a perturbation element 23 is removed from the pattern shown in FIG. 3A so as to provide a linearly polarization element.

Although in the aforementioned embodiment, the emitting circuit plate 11, the first dielectric plate 12, the feeder circuit plate 13, and the second dielectric plate 14 are provided separately from each other, it is possible to etch a single side or both sides of fluorine-contained resin, polyolefine resin or the like so as to integrate the emitting circuit plate 11 with the first dielectric plate 12, the feeder circuit plate 13 with the second dielectric plate 14, and the emitting circuit plate 11 with the first dielectric plate 12 and the feeder circuit plate 13, respectively.

Although the above embodiment is so structured as to contain the second dielectric plate 14 and the ground plate 15, it is permissible to construct without these components.

In the embodiments and modification described above, the following operation and effect have been obtained. Because according to the present invention, in the tri-plate structure planar antenna comprising the ring circular emitting element 21 made of micro-strip antenna element, the metallic conductor cross bridge 22 is provided in an interior area of the ring circular emitting element 21, mode symmetry for antenna excitation is improved and pattern symmetry is improved thereby making it possible to restrict cross-polarization components. Thus an element having a wide range ring ratio becomes available. Further, by adjusting the slot width W of the ring slot 24 and adjusting the shape of the path of the feeder line 13*a* and the length L of overlap between the feeder line 13*a* and the ring circular emitting element 21, impedance matching at a wide range ring ratio is facilitated.

Meantime, by adjusting the slot width W of the ring slot 24, broadband of the antenna characteristic can be attained. By adjusting the shape of the path of the feeder line 13*a* and the length L of overlap area between the feeder line 13*a* and the ring circular emitting element, matching in both the circularly polarization element and the linearly polarization element can be attained. When the array antenna 30 is made by using the emitting elements 21, by controlling the width d between the elements, it is possible to restrict unrequired modes in feeder system and realize high gain and high efficiency. Further, when the emitting element 21 is utilized, because the perturbation elements 23 can be installed by a simple modification of pattern, it is possible to realize circularly polarization easily.

Features of the planar antenna according to the present invention can be summarized as follows.

(1) A planar antenna comprises: an emitting circuit plate having an emitting element made of a micro-strip antenna element; a first dielectric plate; and a feeder circuit plate having a feeder line, in which said feeder line are electromagnetically connected to said emitting element in said emitting circuit plate, and said emitting element is a ring circular emitting element containing a cross bridge conductor in the center thereof.

(2) In a planar antenna of (1), a first ground plate formed to surround said emitting element and therearound is further provided.

(3) In a planar antenna of (2), an impedance matching between said emitting element and said feeder line is performed by adjusting a slot width of a ring slot between said emitting element and said first ground plate and further adjusting a shape of a path of said feeder line and a length of overlap area between said feeder line and said emitting element.

(4) In a planar antenna of (1) or (2), a second dielectric plate and a second ground plate are further provided.

(5) In a planar antenna of (1), an array antenna in which a plurality of said emitting element are two-dimensionally arranged is contained and an interval between said emitting element in said plurality thereof is adjustable.

(6) In a planar antenna of (1), said emitting element contains perturbation elements.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A planar antenna comprising:

a radiating circuit plate having a radiating element made of a micro-strip antenna element;

a first dielectric plate; and a feeder circuit plate having a feeder line, wherein said radiating element is excited by electromagnetically connecting said feeder line to said radiating element in said radiating circuit plate, and said radiating element is a ring circular radiating element containing a cross bridge conductor in a center thereof.

2. A planar antenna according to claim 1, further comprising a first ground plate formed around said radiating element to surround said radiating element.

3. A planar antenna according to claim 1, further comprising a second dielectric plate and a ground plate.

4. A planar antenna according to claim 2, wherein an impedance matching between said radiating element and said feeder line is performed by adjusting a slot width of a ring slot between said radiating element and said first ground plate, a shape of a path of said feeder line, and a length of overlap area between said feeder line and said radiating element.

5. A planar antenna according to claim 2, further comprising a second dielectric plate and a second ground plate.

6. A planar antenna according to claim 1, wherein said radiating element includes a plurality of radiating elements, an array antenna having said plurality of radiating elements which are two-dimensionally arranged is provided, and said plurality of radiating elements is arranged in a predetermined interval.

7. A planar antenna according to claim 1, wherein said radiating element contains a perturbation element.

* * * * *